US009902189B2

(12) United States Patent
Gilbertson et al.

(10) Patent No.: US 9,902,189 B2
(45) Date of Patent: Feb. 27, 2018

(54) VERTICAL POCKET FOLDER

(71) Applicant: Smead Manufacturing Company, Hastings, MN (US)

(72) Inventors: David J. Gilbertson, Hastings, MN (US); Daniel Seleski, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 0 days.

(21) Appl. No.: 15/161,513

(22) Filed: May 23, 2016

(65) Prior Publication Data

US 2016/0263933 A1 Sep. 15, 2016

Related U.S. Application Data

(63) Continuation-in-part of application No. 14/092,135, filed on Nov. 27, 2013, now Pat. No. 9,346,588.

(60) Provisional application No. 61/732,370, filed on Dec. 2, 2012.

(51) Int. Cl.

| | |
|---|---|
| ***B42F 7/06*** | (2006.01) |
| ***B65D 27/08*** | (2006.01) |
| ***B42F 7/00*** | (2006.01) |

(52) U.S. Cl.

CPC ..... *B42F 7/06* (2013.01); *B42F 7/00* (2013.01); *B65D 27/08* (2013.01)

(58) Field of Classification Search

CPC ... B42F 7/06; B42F 7/00; B31B 49/04; B65D 27/08

USPC ..... 229/67.1–67.4

See application file for complete search history.

(56) References Cited

U.S. PATENT DOCUMENTS

| | | | | |
|---|---|---|---|---|
| 867,789 | A | 10/1907 | Bushnell | |
| 984,482 | A * | 2/1911 | Howell et al. | B42F 7/06 229/67.4 |
| 1,373,222 | A | 3/1921 | Bushnell, Jr. | |
| 1,403,070 | A | 1/1922 | Bushnell, Jr. | |
| 2,252,177 | A * | 8/1941 | Heyer | A45C 1/06 150/138 |
| 5,806,754 | A | 9/1998 | Boyle | |
| 5,921,463 | A * | 7/1999 | Boyle | B65D 27/08 229/67.3 |
| 6,168,340 | B1 * | 1/2001 | Lehmann | B42F 7/06 281/38 |
| 6,286,752 | B1 | 9/2001 | Heyer | |
| 6,354,486 | B1 * | 3/2002 | Ho | B65D 27/22 229/67.3 |
| 6,382,864 | B1 * | 5/2002 | Moor | B42F 7/02 206/37 |
| 6,607,122 | B1 | 8/2003 | Ong | |
| 6,672,439 | B2 | 1/2004 | Platte, III | |
| 6,796,428 | B1 | 9/2004 | Ong | |
| 6,831,368 | B2 | 12/2004 | Iijima | |

(Continued)

*Primary Examiner* — Peter Helvey

(74) *Attorney, Agent, or Firm* — Altera Law Group, LLC

(57) ABSTRACT

A vertical file folder system is disclosed in several embodiments. The folder (10) has a plurality of pocket segments 20, 30, 32 which are joined together at their bottom by living hinges 38 which maintain the bottoms edges 16, 116, 216 spaced apart. Port 28 also allow for expansion as do slots 60. An alternative embodiment (FIG. 9-10) show a folder which has a bottom flap 320, side flap 322 and top flap 318 which overlie each other to create a three sided boundary for papers or other contents.

8 Claims, 10 Drawing Sheets

(56) References Cited

U.S. PATENT DOCUMENTS

| | | | | |
|---|---|---|---|---|
| 7,306,134 | B1 * | 12/2007 | Ong | B42F 7/06 229/67.1 |
| 7,458,501 | B1 | 12/2008 | Pelleg | |
| D662,132 | S | 6/2012 | Smith et al. | |
| 2004/0069841 | A1 | 4/2004 | Wong et al. | |
| 2005/0098615 | A1 * | 5/2005 | Lockhart | B42F 7/02 229/67.3 |
| 2005/0156017 | A1 * | 7/2005 | Crum | B42F 7/06 229/67.1 |
| 2006/0060641 | A1 * | 3/2006 | Taylor | A45C 7/0095 229/67.1 |
| 2006/0081689 | A1 * | 4/2006 | Sierra | B42F 7/04 229/67.1 |
| 2006/0278686 | A1 | 12/2006 | Rittmann | |
| 2008/0197175 | A1 | 8/2008 | Christensen et al. | |
| 2008/0257940 | A1 * | 10/2008 | Busam | B42F 7/06 229/67.1 |
| 2011/0272456 | A1 * | 11/2011 | Nething | B42F 7/04 229/67.1 |
| 2012/0175407 | A1 * | 7/2012 | Busam | B42F 21/02 229/67.1 |
| 2013/0320074 | A1 * | 12/2013 | Leonard | B42F 7/06 229/67.1 |
| 2014/0001245 | A1 * | 1/2014 | Makofsky | B42F 7/02 229/67.3 |
| 2014/0191020 | A1 * | 7/2014 | Busam | B42D 1/007 229/67.1 |
| 2015/0115021 | A1 * | 4/2015 | Busam | B42F 11/00 229/67.1 |
| 2015/0144685 | A1 * | 5/2015 | Sierra | B42F 7/06 229/67.4 |

* cited by examiner

VERTICAL POCKET FOLDER

BACKGROUND OF THE DISCLOSURE

Field of the Disclosure

The present disclosure is directed to a pocket folder having vertical access openings.

Description of the Related Art

Pocket folders have been around for a long time, typically however, they have been designed for access from their longitudinal side, rather than top access, consistent with brief case and file drawer access. An alternative usage namely with backpacks, requires the folder to be more easily accessed thru its shorter (typically) top edge since a backpack has a narrower opening than a brief case. It would seem that merely shifting the opening on a known longitudinal file pocket would suffice, but the short dimension of the opening allows less area for the pocket to accommodate the same stack of papers which would be easy to accommodate in a traditional horizontal pocket folder. The shorter dimension allows less space to spread the puckering across and stresses all elements of the pocket leading to early failure.

Another problem with vertical filing is that the papers have a much greater tendency to fall out because the pockets do not cover as much of the paper contents as in horizontal filing. That is because if the pockets are made equally deep as in horizontal filing, then it becomes hard to remove the papers (due to their lateral span being so much shorter) and the pockets would have to include an accordion sidewall to accommodate the deeper insertion of deep pockets. Accordion sidewalls are expensive, bulky and are less effective at frictionally retaining paper. In short, vertical file pockets present challenges not found in horizontal filing and require different solutions.

A method of manufacture is also disclosed.

The present disclosure in it various embodiments overcomes these problems.

BRIEF SUMMARY

The disclosure encompasses many embodiments. One such embodiment is detailed below in summary fashion. Please understand that this summary does not encompass the entire disclosure but is provided to assist the reader in reviewing the entire disclosure and claims which also constitute part of the disclosure.

There is disclosed a multi-pocket file folder comprising: a first pocket having a first back portion having two sides, a first top edge and a first bottom edge; a first flap extending from the bottom edge upwardly toward said top edge but terminating distant therefrom to form a pocket therebetween; sidewalls bridging said flap and back portion on both sides; said sidewall terminating a predetermined distance from said bottom edge, thereby creating a void area between said flap and back portion adjacent said bottom edge, said void providing expansion space for papers in said pocket. The term papers are intended to mean any article receivable in the pocket. There may also be a second pocket having a second back portion having two sides, a second top edge and a second bottom edge; a second flap extending from the second bottom edge upwardly toward said second top edge but terminating distant therefrom to form a pocket therebetween; second sidewalls bridging said second flap and second back portion on both sides; said second sidewall terminating a predetermined distance from said second bottom edge, thereby creating a void area between said second flap and second back portion adjacent said second bottom edge, said void providing expansion space for papers in said second pocket, the distance between said sidewalls defining a lateral opening extent. There may also be a flexible bridging material connecting said first and second pockets at said bottom edges, said bottom edges separated from each other from contact by said material whereby expansion space is provided between said first and second pockets and optionally a cover flap having a lateral extent less that that lateral opening extent of said second pocket and extending from said first top edge and being bendable down and into said second pocket between said second flap and said second back portion; to protect papers in the folder.

There is also disclosed a multi-pocket file folder having a first pocket comprising a first back portion having two sides, a first top edge and a first bottom edge; a first flap extending from the bottom edge upwardly toward said top edge but terminating distant therefrom to form a pocket therebetween, said flap including proximate the bottom edge a plurality of spaced apart slots extending upwardly, thereby providing expansion space for papers in the pocket; sidewalls bridging said flap and back portion on both sides; a second pocket comprising a second back portion having two sides, a second top edge and a second bottom edge; a second flap extending from the second bottom edge upwardly toward said second top edge but terminating distant therefrom to form a pocket therebetween, said flap including proximate the bottom edge a plurality of spaced apart slots extending upwardly, thereby providing expansion space for papers in the pocket; second sidewalls bridging said second flap and second back portion on both sides; said second sidewall terminating a predetermined distance from said second bottom edge, thereby creating a void area between said second flap and second back portion adjacent said second bottom edge, said void providing expansion space for papers in said second pocket, the distance between said sidewalls defining a lateral opening extent; a flexible bridging material connecting said first and second pockets at said bottom edges; a cover flap having a lateral extent less that that lateral opening extent of said second pocket and extending from said first top edge and being bendable down and into said second pocket between said second flap and said second back portion; to protect papers in the folder.

The pocket folder of above may further include shear guard feature comprising a diagonal slot in said back portion distant from said pocket and adjacent an edge of the back portion said slot adapted to allow a corner of papers in the pocket to pass thru further retaining the papers and providing a shear guard against tearing a staple point in the corner of the papers.

Also disclosed is a method of making a vertical file folder with a living hinge using tape. The method uses a jig or a holder which can maintain the folder portions in place while taping. The first folder portion is made by folding a longitudinal blank of material into sections: a cover flap 18 (optional) at fold line 14, a back panel 12 at fold line 16 and side flaps 24. The blank is preferably cut so that the flaps do not extend to the bottom fold line 16, thereby creating apertures/voids 28. Then the above assembled portion is put into a planar jig (a planar structure with guide walls or pins). An insert second blank is folder 112 is similarly folded to create a pocket 30 and placed in the jig end to end with the end of first folder portion and the end of the second portion proximate, but not touching, leaving a gap which will allow for the hinge. Tape is then applied overlying a portion of each of the first and second folder portions and the gap therebetween. See FIG. 7. The pair of portions is then flipped over and a second tape is applied in a mirror image to the first tape, but on the other side. The gap becomes a hinge of double thickness tape. Further pocket sections can also be added by simply folding the first and second pocket sections such as seen in FIG. 1, so that the two portions are now stacked and a third pocket portion (folded per above to create a pocket) is placed in the jig where the second portion was, is adjacent end to end but not touching, leaving a gap. Tape is applied as before and becomes a hinge as above. Additional portions can be added as desired to build a multi-pocket bottom hinged system.

Many other features and combinations are disclosed and claimed.

DETAILED DESCRIPTION

A file folder 10 is disclosed various embodiments and will be described in detail below. A method of manufacturing same is also disclosed.

Figures 1, 1A:
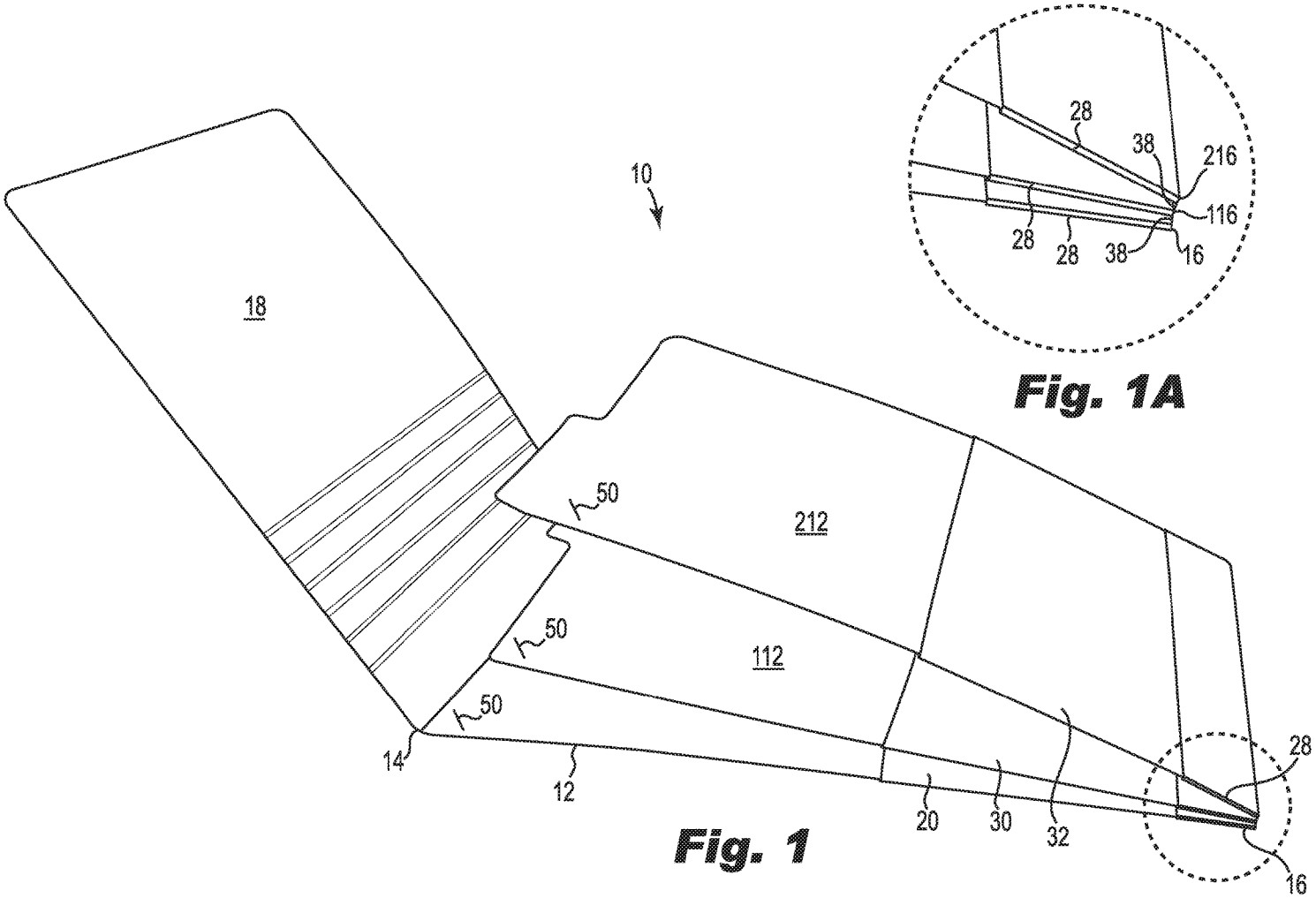
FIG. 1 is a perspective view of one embodiment of a vertical file folder.
FIG. 1*a* is a close up view of the hinge section of the folder in FIG. 1.
Figure 2:
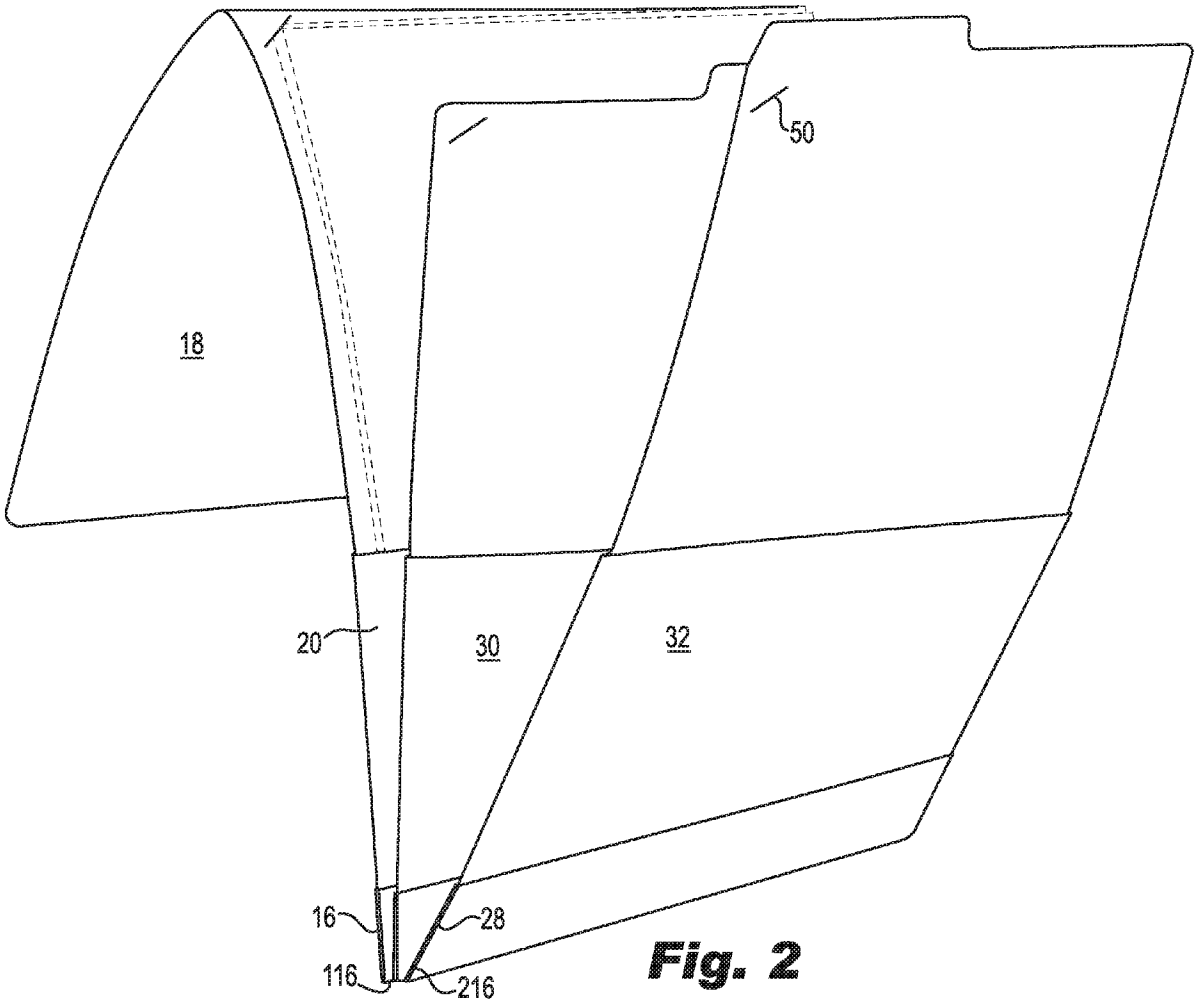
FIG. 2 is a front perspective view of the folder in FIG. 1.
Figure 3:
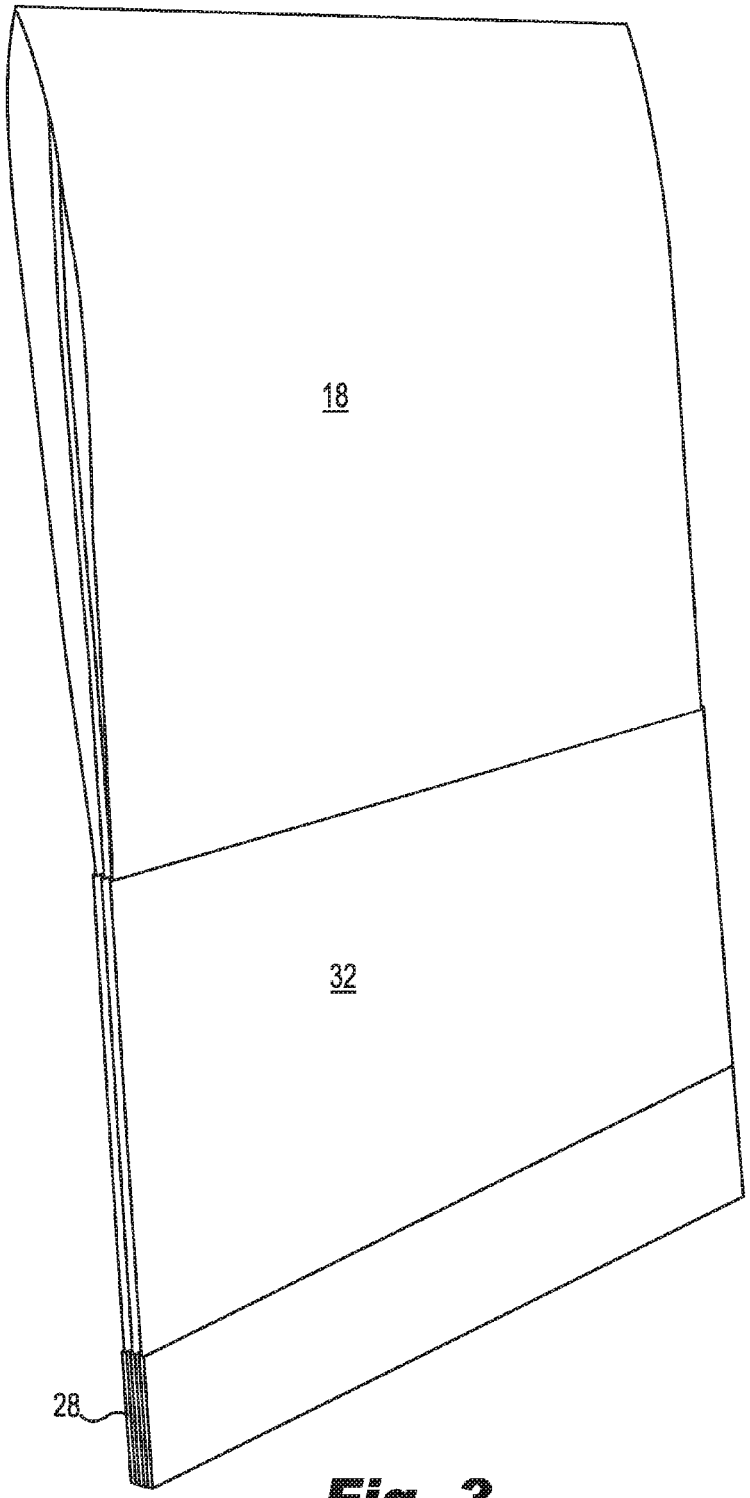
FIG. 3 is a view like FIG. 2 except that the cover flap is folded over.
Figure 4:
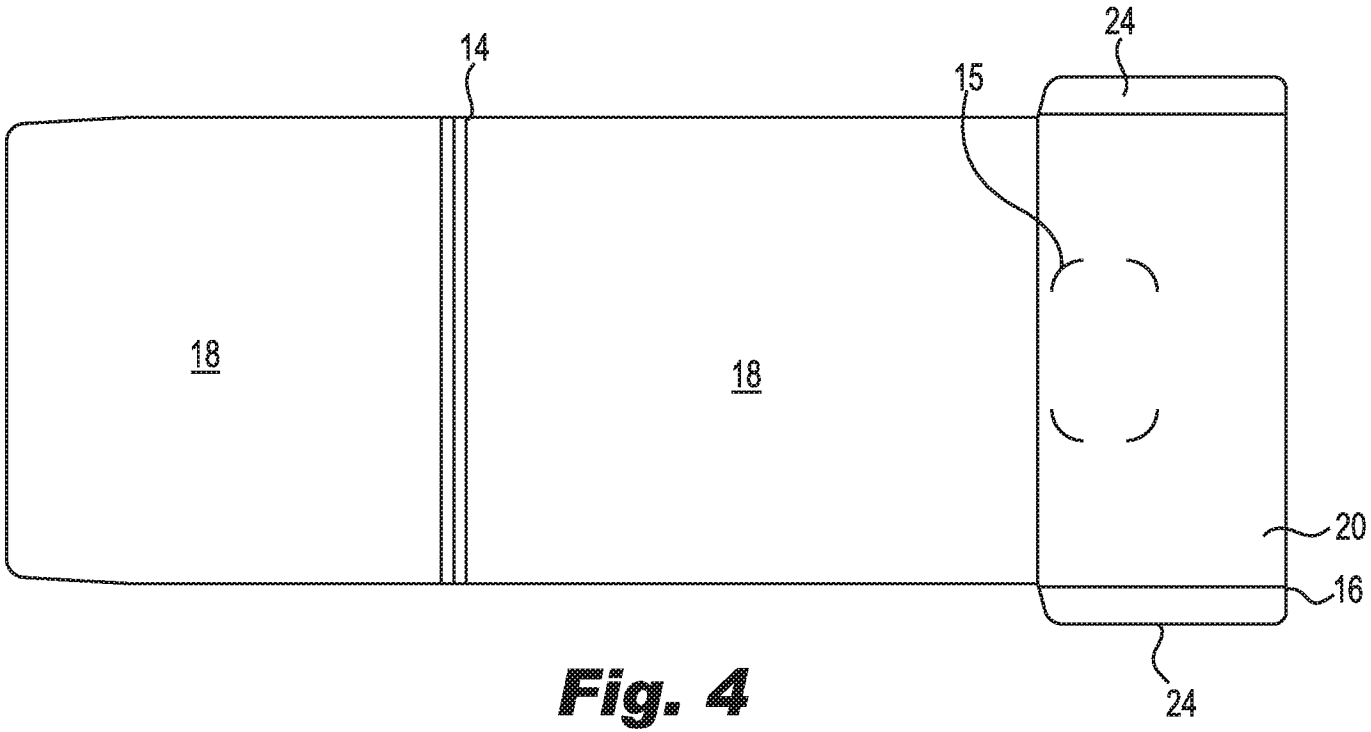
FIG. 4 is a view like FIG. 3 from another perspective.

The embodiment in FIG. 1 is also illustrated in an unfolded state in various other figures including 4, 5, 6, and 7. In the preferred embodiment, the folder 10 has a back panel 12 which has top and bottom edges 14, 16. A cover flap 18 extends from the top edge 14 and is preferably an extension thereof. The preferred material throughout is paper, paperboard or other fibrous material, though plastics and other materials which are bendable and/or scoreable are also usable. Cuts 15 (FIG. 4) are for retaining business cards or the like.

Figure 5:
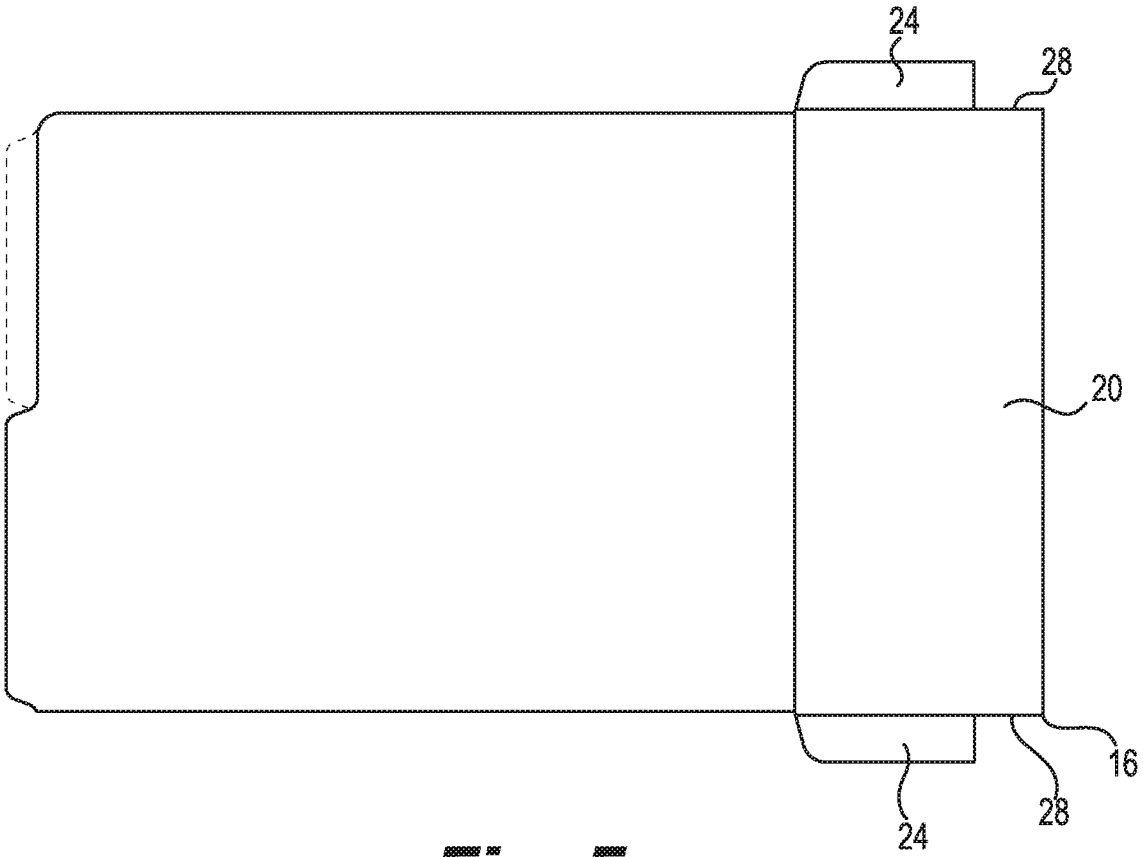
FIG. 5 is a top plan view of one panel of the folder folded to create a first pocket.
Figure 6:
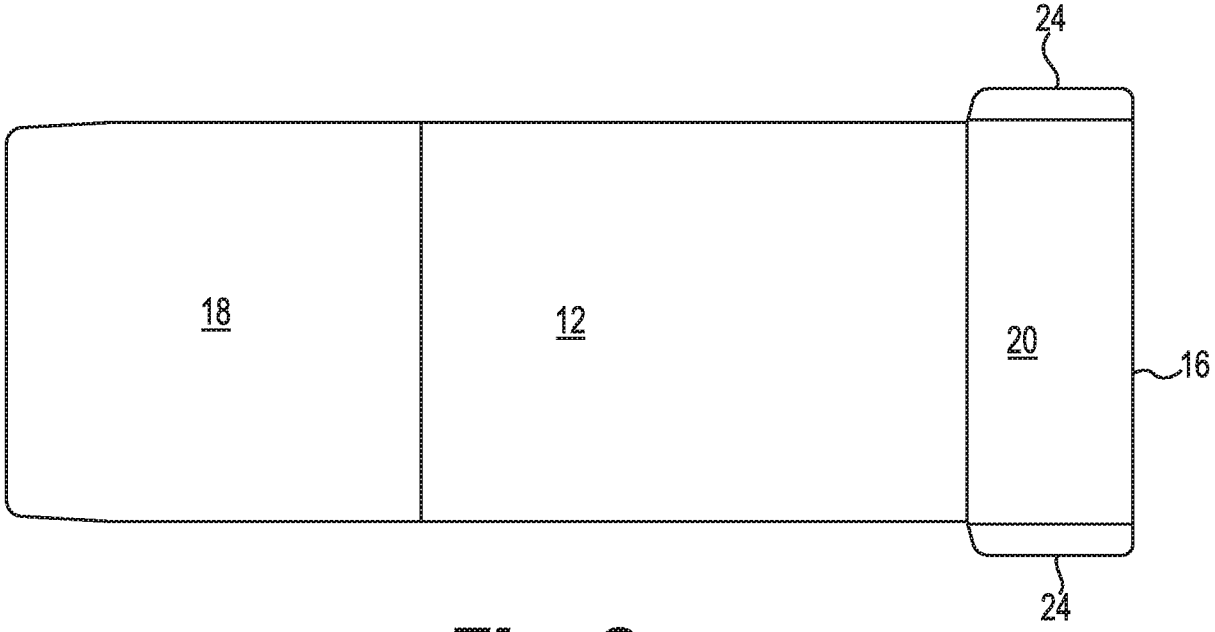
FIG. 6 is a top plan view on an insert pocket section.

Extending from the bottom edge 16 is a pocket flap 20 which has two side wall tabs 24 (see FIGS. 4, 5, 6, and 7). Side wall tabs 24 are folded over and affixed to the back side of panel 12. In the preferred embodiment the tabs have score lines to create an extra fold creating a gusset to expansion space. Also in the preferred embodiment as shown in FIGS. 1 and 5, the tabs do not extend down to the bottom edge 16 but terminate a distance therefrom, (as shown, about 25 mm) to prove an opening in the pocket. This reduces the shear force in the lower end of the pocket which arises when the pocket is filled with materials/paper. Because the pocket panel and back panel are joined at the bottom 16, the space available for papers diminishes. This would result in less paper space unless the convergence area extending upwardly from the bottom edge did not have an opening port 28 to relieve the pressure/strain. Port 28 reduces these forces and greater capacity in the pocket.

Figure 7:
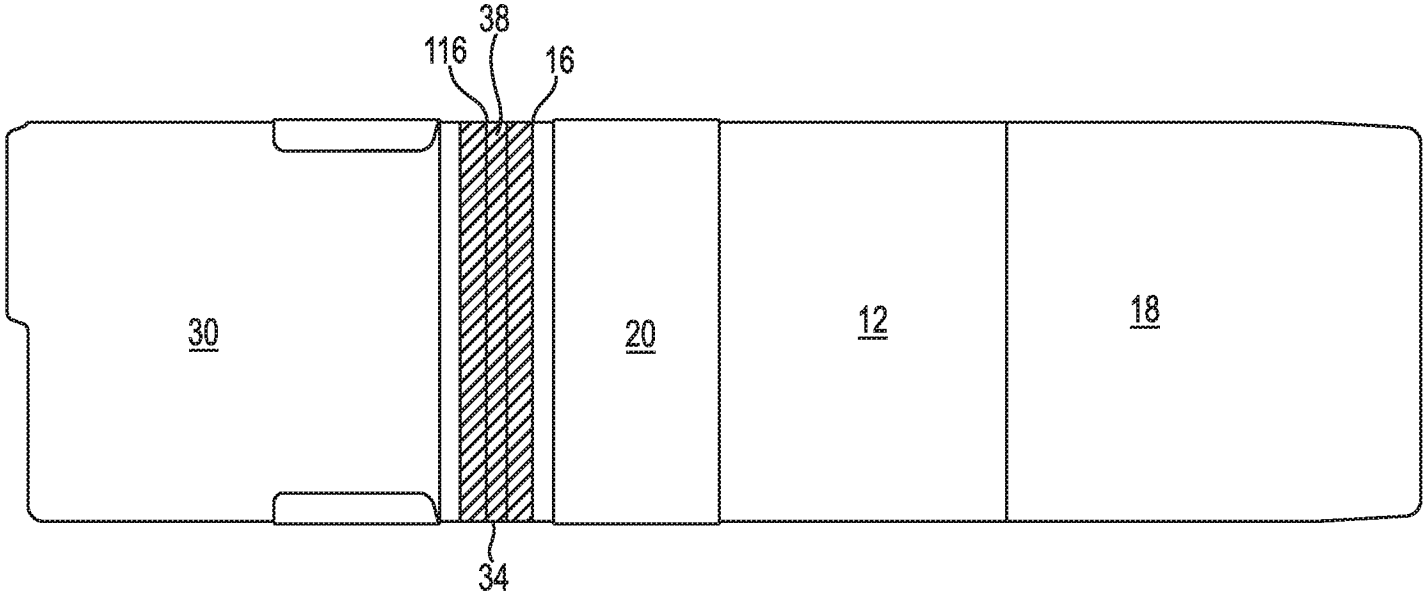
FIG. 7 is a top plan view like FIG. 5 with different relative dimensions.

In addition to packet 20, the preferred embodiment has additional pocket segments. In FIG. 1, two additional segments 30, 32 are shown, but there can be any reasonable number added. One such segment 30 is shown in FIG. 7, where the bottom edge 16 of the back panel is joined to the bottom edge 116 of segment 30 by a flexible bridging material 34 which is bonded to the surface of a bottom portion of 20 and 30 to create a flexible joint/hinge. This material 34 is preferably an adhesive tape or Tyvek® material which adheres permanently to both outer and inner surfaces at the bottom (i.e. the back portion and pocket face), and performs as a living hinge. Tape is preferably applied on both sides of the joint. In the preferred embodiment, the bottom edges 16, 116 are not in contact, but spaced apart to create a gusset section 36 which accommodates the expansion of the pockets when filled. The living hinge or gusset is created during assembly by laying out the pockets 20, 30 end to end on a flat jig but keeping them spaced apart while taping one side. This gap creates the hinge. When the folder is turned over for taping on the other side, the two pieces of tape come into direct contact in the gap region to form a double thickness tape which creates a strong hinge. The third or successive pocket segments are attached in a similar way on a jig by folding all previously joined pocket segments into a stack, putting it into a jig, placing the next pocket segment end to end in the jig but spaced apart from the stack. Then joining the stack and now pocket segment with tape, leaving a gap for the hinge, flipping the folder over and taping the other side, so that a double thickness living hinge is created in the gap. Further pocket segments can be created by repeating this process.

This makes it possible to add any number of additional pocket segments and also means that the hinge/joint will be double thickness in the gusset area 38.

To add additional pocket segments, such as shown if FIG. 1, segment 30 is folded over and its bottom 116 becomes one half of a joint/hinge with the next segment 216 (FIG. 1*a*). The hinge is formed with tape and a gusset portion just as explained above.

An additional feature, diagonal cut 50 is optional applied toward an upper corner of the back portions 12, 112, 212 of pocket segment. This diagonal cut performs two functions. First, it receives a corner of paper to help keep it in the pocket. It provides shear protection for stapled papers. When papers are stapled, the shear force is focused on the staple making them easy to shear/rip. By tucking the paper corner and staple under the diagonal slot the shear point is spread over a larger area and shear forces are reduced. Making the diagonal cuts hemispherical (concave or convex) will further reduce such forces.

Figure 8A:
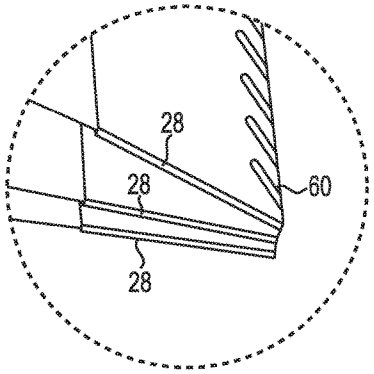
FIG. 8*a* is a close up fragmentary view of a portion of FIG. 8.
Figure 8:
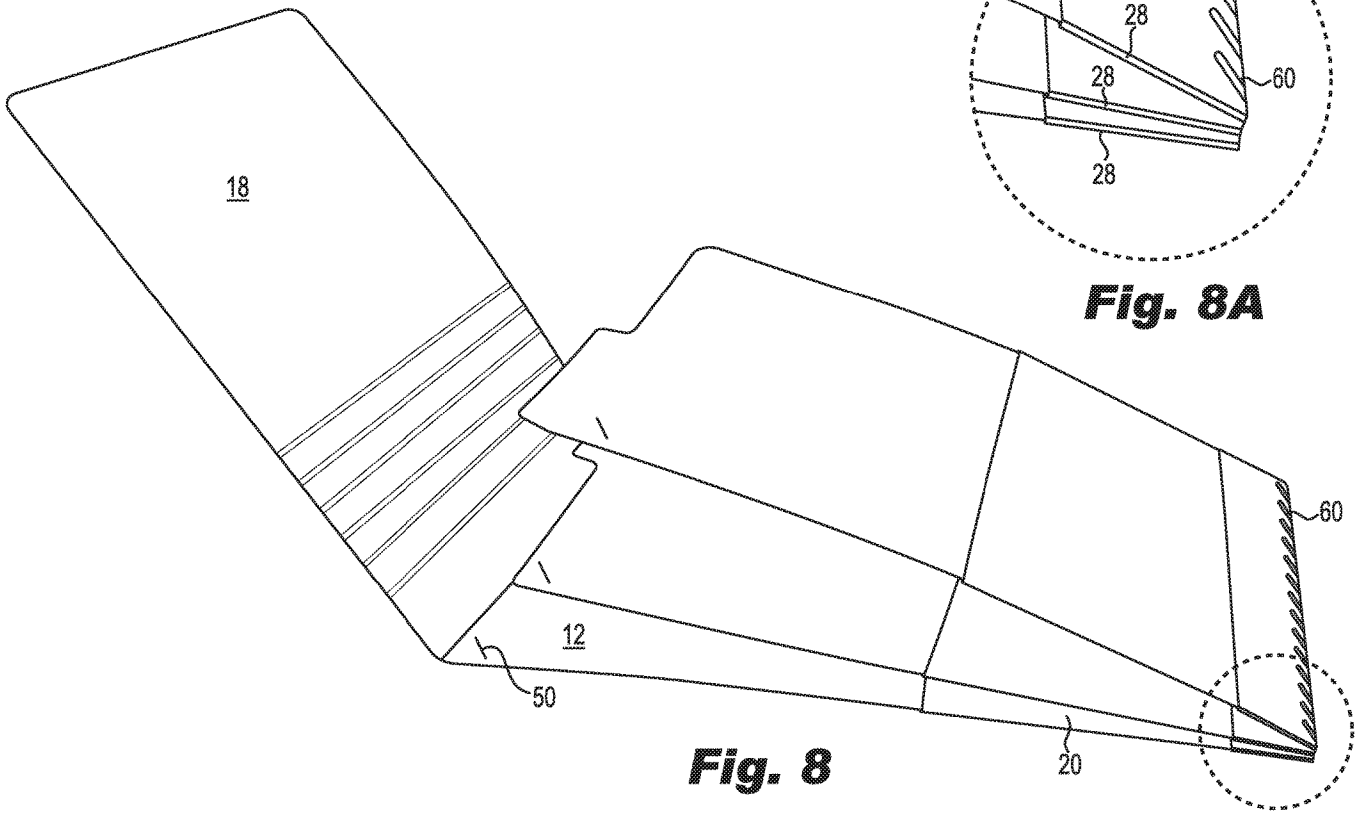
FIG. 8 is a view of a back panel with pocket attached to an insert pocket section by a hinge (diagonal lines).

FIGS. 8 and 8*a* illustrate an additional solution to accommodating papers (i.e. items) in the pockets. The bottom edge, or adjacent the bottom edge, are a plurality of spaced apart apertures 60. In the preferred embodiment, the apertures are elongated slots, also preferably cut diagonally thru the material. The shape of the slots may vary but the preferred arrangement is shown as being oblong with parallel sidewalls and having rounded ends (one end not visible) to reduce shearing. They may be oval or round as well as other shapes. Avoidance of sharp corners is preferable. The slots 60 are shown equally spaced along the bottom edge. They can be irregularly spaced or grouped toward the corners in higher concentration than in the middle where stresses are least. They may also be used in place of openings/ports 28 which relieve stress, by including such slots along the vertical edges (see FIGS. 9/10 for an example, though on another embodiment). Thus the ports 28 may be replaced by slots 60 on the sides only, and not be used on the bottom edge. All combinations of slots and ports are possible.

Figure 9:
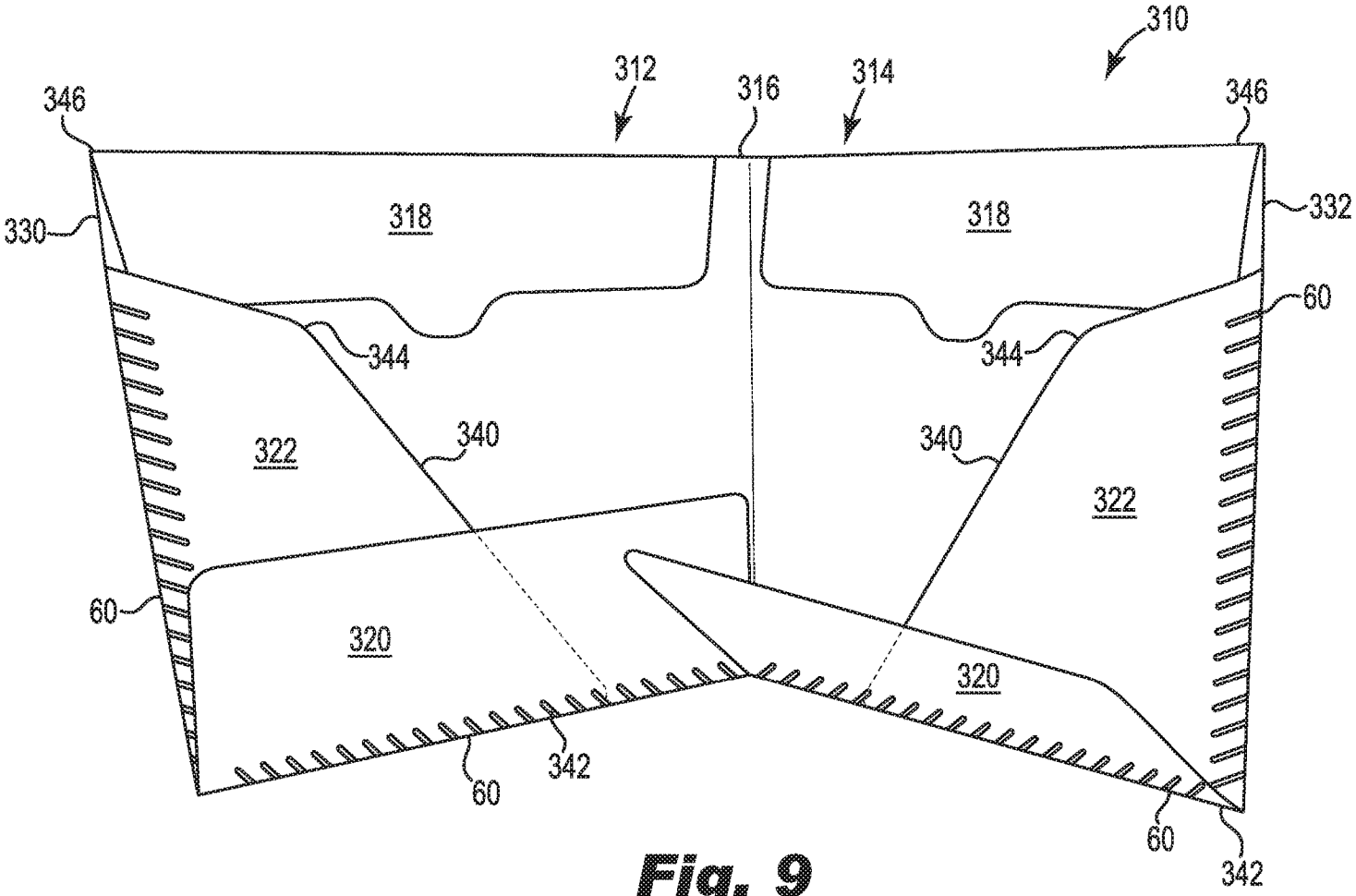
FIG. 9 is an alternate embodiment in perspective view.
Figure 10:
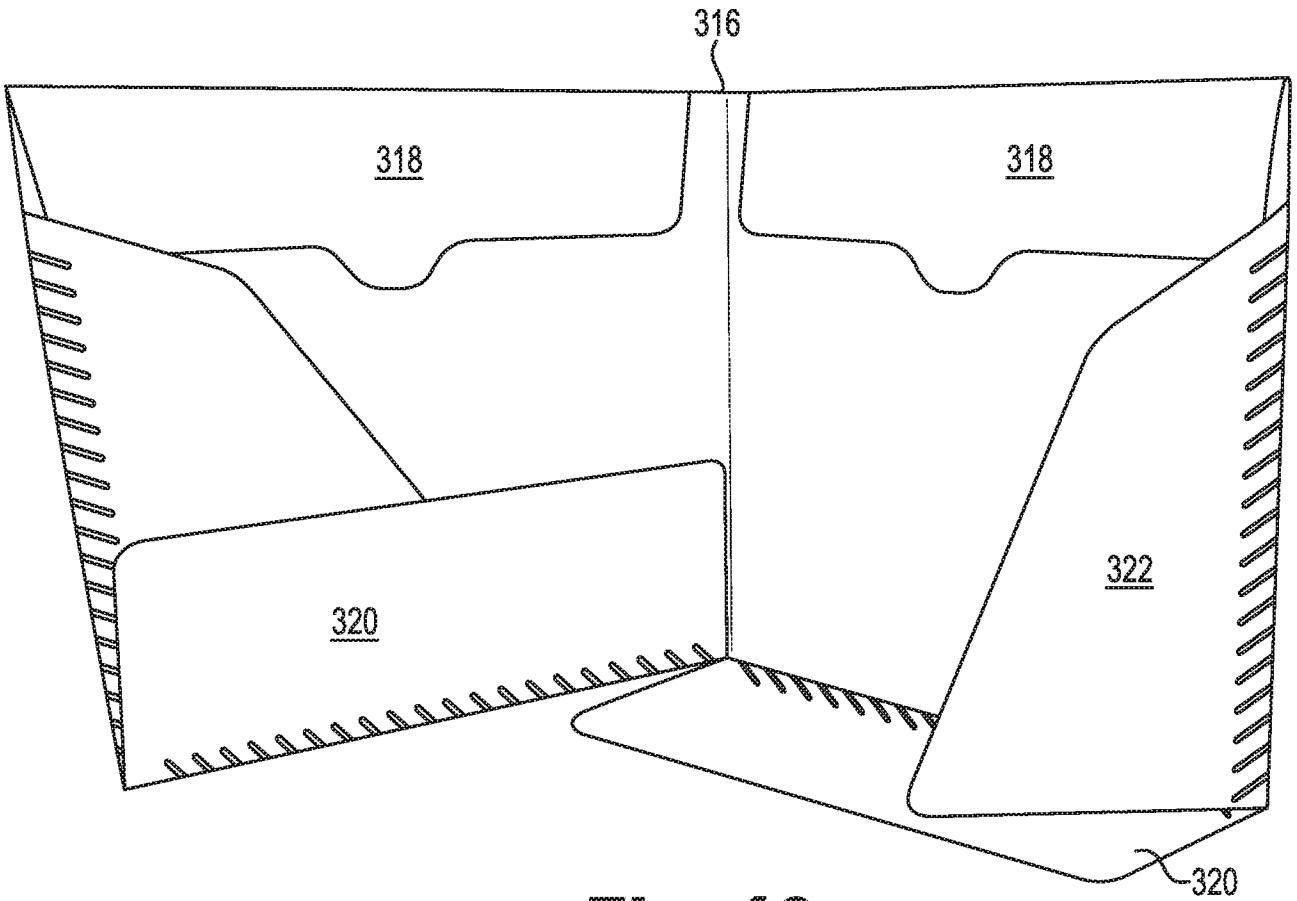
FIG. 10 is a view like FIG. 9 with one flap folded away.

FIGS. 9-10 illustrate another embodiment which can also be used for vertical or horizontal filing but which provides multiple pockets and flaps.

Folder 310 is shown as preferably symmetrical on a center fold 316 with left and right back panels 312, 314. In the symmetrical embodiment (as shown) the sides differ only in that they have left or right flap 322 affixed to their respective side edges 330, 332. Side flaps 322 may be perforated along their edges with slots 60 as shown, or other stress relieve means as explained herein for other embodiments. The side flaps have a diagonal edge 340 which extends from the bottom edge (obscured but shown in dotted lines) which is a straight across edge terminated just above the bottom edge 342. The diagonal edge 340 may be a straight line to the bottom edge, or have a slight curvature at point of termination similar to the curvature 344 toward the upper edge. The upper termination of flap 322 therefore preferably follows a first angular (diagonal) path, and then a second more oblique angular path at 344 to the edge 332. This will eliminate puckering of papers if the flap terminated at the top edge 346. The preferred construction terminates a predetermined distance from the top edge 346, but sufficiently high to be partially cover flap 318 thereby creating a partial retainer for the flap underneath, as shown in the figures.

A lower flap 320 extends from the lower edge 342 at a fold line and folds upwardly toward the upper edge. It provides a bottom pocket region and may have slots 60 as shown for expansion. Its depth is typically one third to one half of the height of the back panel 312, 314. The lower flap when closed, therefore intersects and overlies side panel 372 to form two sidewalls of the pocket, the folded over folder providing the other sidewall and the top flap, which intersects and underlies side flap 372, provides the top closure. Thus the preferred structure has the lower flap intersecting and overlying the side flat at least in part, and the side flat intersecting and overlying the top flat, at least in part to create an interlocking, overlapping three sided pocket.

Papers/contents of the folder can be removed in many ways such as shown in FIG. 10 where the bottom flap is opened and then the side flap. Otherwise, the top flat can be opened and the papers withdrawn vertically. By operation of this structure, the folder has great utility, can hold thick contents but is compact and can be made from a single blank which is cut in a single step. This folder includes the method of construction which can be characterized as, creating a folder from a single planar blank, folding a portion of the blank upwardly to create a bottom pocket, folding a portion of the side inwardly to create a sidewall to the pocket, such that at least a portion of the sidewall is engaged underlies the bottom portion when folded upwardly and an (optional) top flap which is a portion of the planar sheet folded downward toward the bottom flap, the top flap extended sufficiently downwardly that it is engaged and underlies the side flap when both in their folded positions.

The description of the invention and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A multi-pocket file retaining folder comprising: a first pocket comprising:

a) a first back portion having front and rear faces, two sides, a first top edge and a first bottom edge, and inner out outer side edges;

b) a first pocket flap extending from the bottom edge upwardly toward said top edge;

c) a second top flap extending from the top edge and being foldable over a portion of said back portion;

d) a third side flap extending from the outer edge and having a diagonal distal edge running diagonally from adjacent said upper edge to adjacent said lower edge, said flap being narrower adjacent said upper edge and wider adjacent said lower edge, so that when said third flap is folded, and said first pocket flap is folded over said third flap, a pocket is formed with a diagonal edge to allow viewing of items within the pocket;

said first flap overlying said third flap and slidably engaging said third flap no permanent affixation between said first and their flaps;

said flaps all being hingeably foldable toward said front face so that the flaps together provide retention for items within the first pocket;

said flaps all being hingeably foldable toward said front face so that the flaps together provide expandable retention for items within the first pocket so that when items are inserted in said first pocket, all of said flaps are able to deflect thereby creating a larger first pocket;

said first and second pockets being hingeably joined along the inner edges to permit the pockets to be folded together.

2. The folder of claim 1 wherein third flap include a first diagonally cut distal portion extending from adjacent said top edge and toward said inner edge and then a second diagonal portion, extending from said first diagonal portion immediately adjacent said lower edge, so that the side flaps follow a two part path from adjacent the top edge to adjacent the bottom edge.

3. The folder of claim 1, further including a plurality of spaced apart elongated diagonal pressure relieve slots in said side first flap extending from the outer edge.

4. The folder of claim 1, further including a plurality of spaced apart elongated diagonal pressure relieve slots in said fourth flap extending from the bottom edge.

5. The folder of claim 3 wherein said upper edge of said third side flap slidably intersects only a portion of said second flap when folded thereover.

6. A multi-pocket file retaining folder comprising:

a first pocket comprising:

a) a first back portion having front and rear faces, two sides, a first top edge and a first bottom edge, and inner out outer side edges;

b) a first pocket flap extending from the bottom edge upwardly toward said top edge;

c) a second top flap extending from the top edge and being foldable over a portion of said back portion;

d) a third side flap extending from the outer edge and having a diagonal distal edge running diagonally from adjacent said upper edge to adjacent said lower edge, said flap being narrower adjacent said upper edge and wider adjacent said lower edge, so that when said third flap is folded, and said first pocket flap is folded over said third flap, a pocket is formed with a diagonal edge to allow viewing of items within the pocket;

said flaps all being hingeably foldable toward said front face so that the flaps together provide retention for items within the first pocket;

a second pocket comprising:

1) a second back portion having front and back faces, two sides, a first top edge and a first bottom edge and inner out outer side edges;

2) a fourth pocket flap extending from the bottom edge upwardly toward said top edge;

3) a fifth top flap extending from the top edge and being foldable over a portion of said back portion;

4) a sixth side flap extending from the outer edge and having a diagonal distal edge running diagonally from adjacent said upper edge to adjacent said lower edge, said flap being narrower adjacent said upper edge and wider adjacent said lower edge, so that when said sixth flap is folded, and said fourth pocket flap is folded over said sixth flap, a pocket is formed with a diagonal edge to allow viewing of items within the pocket;

said flaps all being hingeably foldable toward said front face so that the flaps together provide retention for items within the first pocket;

said first and second pockets being hingeably joined along the inner edges to permit the pockets to be folded together, further including a plurality of spaced apart elongated diagonal pressure relieve slots in said side first flap extending from the outer edge, said slots being formed diagonally relative to the axis of the outer edge.

7. The folder of claim 1 said first and second flaps slidably intersect when folded toward said back portion, so that items of varying thickness are maintaining with the pocket.

8. A multi-pocket retaining file folder comprising:

a first pocket comprising:

a) a first back portion having two sides, a first top edge and a first bottom edge, and inner out outer side edges;

b) a first pocket flap extending from the bottom edge upwardly toward said top edge;

c) a second top flap extending from the top edge and being foldable over a portion of said back portion;

d) a third side flap extending diagonally from the outer edge and having a distal edge running diagonally from adjacent said upper edge to adjacent said lower edge, said flap being narrower adjacent said upper edge and wider adjacent said lower edge, said flaps all being hingeably foldable toward said front face and slidably intersecting with each other without affixation to each other, so that the flaps together provide expandable retention for items within the first pocket.

* * * * *